US005706885A

United States Patent [19]

Kim

[11] Patent Number: 5,706,885

[45] Date of Patent: Jan. 13, 1998

[54] HEAT EXCHANGER

[75] Inventor: Hyun Young Kim, Seoul, Rep. of Korea

[73] Assignee: L G Electronics Inc., Seoul, Rep. of Korea

[21] Appl. No.: 603,800

[22] Filed: Feb. 20, 1996

[30] Foreign Application Priority Data

Feb. 20, 1995 [KR] Rep. of Korea ..... 1995-3226

[51] Int. Cl.[6] ..... F28D 1/053

[52] U.S. Cl. ..... 165/151; 165/181

[58] Field of Search ..... 165/151, 181, 165/182

[56] References Cited

U.S. PATENT DOCUMENTS

| | | | |
|---|---|---|---|
| 3,249,156 | 5/1966 | McGrew | 165/181 |

FOREIGN PATENT DOCUMENTS

| | | | |
|---|---|---|---|
| 8380 | 7/1956 | Germany | 165/151 |
| 3406682 | 9/1985 | Germany | 165/151 |
| 194293 | 10/1985 | Japan | 165/151 |
| 266391 | 11/1987 | Japan | 165/151 |
| 136196 | 5/1990 | Japan | 165/151 |
| 369394 | 12/1992 | Japan | 165/151 |

*Primary Examiner*—Leonard R. Leo
*Attorney, Agent, or Firm*—Bell, Boyd & Lloyd

[57] ABSTRACT

A heat exchanger is disclosed including a plurality of plate fins which are disposed in parallel at a predetermined interval and between which air flows; heat transfer tubes through which fluid runs; and a plurality of strips formed on the fins between nearby heat transfer tubes, the strips being divided into first strips formed on a center line connecting the centers of the nearby heat transfer tubes, and second strips opposingly disposed centering on the center line and formed along an ellipse having the center line in the direction of the line of apsides.

3 Claims, 4 Drawing Sheets

HEAT EXCHANGER

FIELD OF THE INVENTION

The present invention relates to a heat exchanger used in an air conditioner to indirectly perform heat exchange between fluids.

BACKGROUND OF THE INVENTION

As shown in FIG. 1, a conventional heat exchanger is made to have heat transfer tubes 2 through which fluid passes, and fins 1 of aluminum so that air induced in the direction of the arrow performs heat exchange between fins 1 and the fluid passing through heat transfer tubes 2.

FIG. 2 is a front view of a conventional heat exchanger. In FIG. 2, the heat exchanger has fins 1 in which strips 4, 14 and 24 are formed transversing a gas path S placed between adjacent heat transfer tubes 2. The respective strips are made to have bridges 7, 17 and 27 between pairs of erect pieces (5,6), (15,16) and (25,26). Strips 14 and 24 are divided in a single direction and placed at the air inlet and air outlet. Strip 4 is placed at the intermediate position and not segmented. Erect pieces 5, 6, 15, and 25 of strips 4, 14 and 24 are formed to have an inclination angle to coincide with the circumference of heat transfer tubes 2. Erect pieces 16 and 26 have an inclination angle with respect to the central line 1 of the gas path. Apertures 8, 18 and 28 of strips 40, 14 and 24 are perpendicular to the direction of air flow. Reference numeral 3 indicates a fin base. The strips are cut and protruded alternately on the front and back surfaces of the fins.

In such heat exchanger the flow of heat moves from heat transfer tubes 2 and 2' to air when the temperature of the tubes is higher than the temperature of air. When the temperature of the tubes are lower than that of air, heat is transferred from air to the tubes.

For convenience, only a case will be described in which the temperature of heat transfer tubes 2 and 2' is higher than air. In case that the temperature of heat transfer tubes 2 and 2' is lower than air, only the direction of heat flow is altered, as compared with the first case.

In this case, because apertures 8, 18 and 28 of strips 4, 14 and 24 are cut from fin base 3, heat of the tubes is not transferred to the apertures but only to bridges 7, 17 and 27 in the direction of arrow a via erect pieces 5, 15 and 25 uncut from fin base 3. It is natural that the flow of heat runs in the direction of arrow b. However, the flow of heat runs in the direction of arrow a because of the cut apertures of the strips, decreasing conduction efficiency of fins 1 as a whole.

SUMMARY OF THE INVENTION

Therefore, it is an object of the present invention to provide a heat exchanger in which the temperature difference between strips and air is set to become larger to enhance heat transfer performance.

To accomplish the object of the present invention, there is provided a heat exchanger including a plurality of plate fins which are disposed in parallel at a predetermined interval and between which air flows; heat transfer tubes through which fluid runs; and a plurality of strips formed on the fins between nearby heat transfer tubes, the strips being divided into first strips formed on a center line connecting the centers of the nearby heat transfer tubes, and second strips opposingly disposed centering on the center line and formed along an ellipse having the center line in the direction of the line of apsides.

BRIEF DESCRIPTION OF THE ATTACHED DRAWINGS

DETAILED DESCRIPTION OF THE INVENTION

Figure 1:
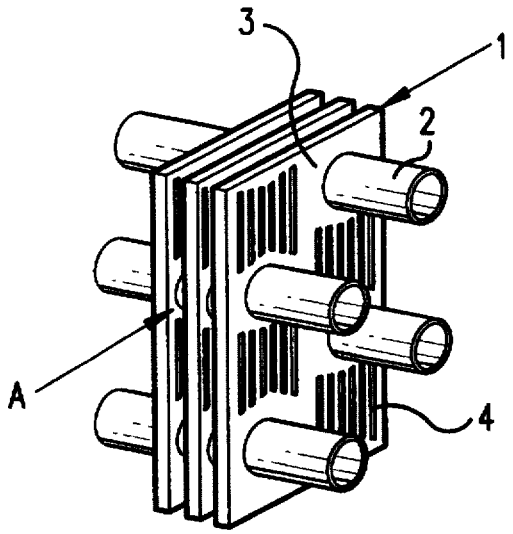
FIG.1 PRIOR ART
FIG. 1 is a perspective view of a conventional heat exchanger.
Figure 2:
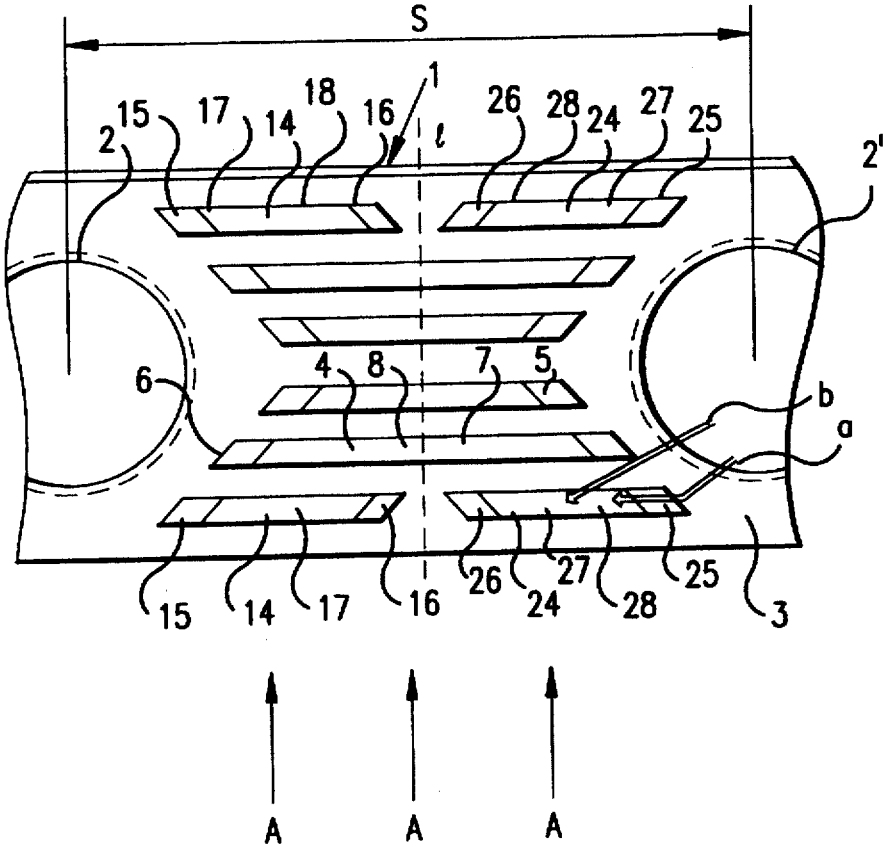
FIG.2 PRIOR ART
FIG. 2 is a front view of the fins of the conventional heat exchanger.
Figure 3:
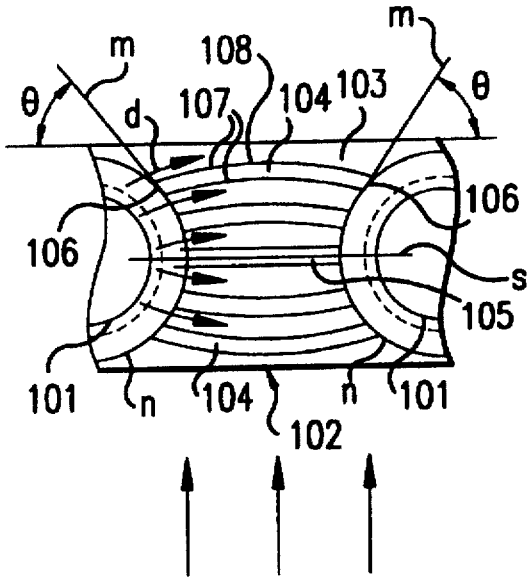
FIG. 3 illustrates one embodiment of a heat exchanger of the present invention.

First of all, a first embodiment of a heat exchanger of the present invention will be described with reference to FIG. 3.

Heat transfer tubes 101 through which fluid passes are perpendicularly inserted into plate fins 102 which are disposed in parallel at a predetermined interval and between which air flows in the direction of the arrow.

Fins 102 each comprise, between two nearby heat transfer tubes 101, a strip 105 formed on the center line S of the heat transfer tube, two line strip 104 formed on a side through which the flow of air is induced at a reference of strip 105, and two line strip 104 formed on a side through which the flow of air runs out.

Two line strip 104 is formed to be elliptical, having its center line S connecting the centers of two nearby heat transfer tubes 101 at the line of apsides. Strip 104 is made to have bridge 107 between a pair of erect pieces 106.

Erect pieces 106 of strip 104 are formed to have an inclination angle θ coinciding with the shape of the circumferential tangent line m of a concentric circle n of heat transfer tube 101 circumscribed with erect pieces 108.

Meanwhile, apertures 107 of two line strip 104 are cut and divided perpendicular to the direction of air flow on fin base 103. The strips may be formed alternately on the front and back surfaces of the fins.

In this configuration, when the temperature of heat transfer tube 101 is higher than the temperature of air, the flow of heat transmitted to fin 102 is indicated by heat flow line d. This heat flow line d runs in the direction of the radius in heat transfer tube 101. Here, the flow of heat runs naturally and is not interrupted by strips 104 because strips 104 formed on fin base 103 coincide with an ellipse having center line S connecting heat transfer tube 101 as the line of apsides.

The heat of heat transfer tube 101 runs along heat flow line d, not interrupted by strips 104, and reaches bridges 108 of the strips via erect pieces 108 of strips 104. Due to conduction to bridges 108 of strips 104, thermal transfer is facilitated so that the difference between the temperature of bridges 108 and the temperature of air flowing through bridges 108 become larger, thus increasing the amount of heat transmitted and raising heat transfer efficiency.

Figure 4:
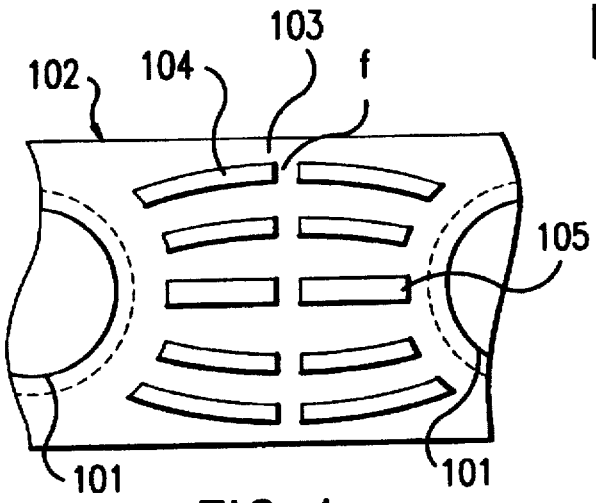
FIGS. 4–10 illustrates another embodiments of the heat exchanger of the present invention.

For another embodiment of the present invention, as shown in FIG. 4, strips 104 and 105 are divided into two along an intermediate line f of heat transfer tube 101. However, similar to the first embodiment of the present invention, heat transfer tube 101 is inserted into plate fins 102. For still another embodiment of the present invention, as shown in FIG. 5, strips 104 are divided into three along an arc g having the same center as heat transfer tube 101.

Figure 5:
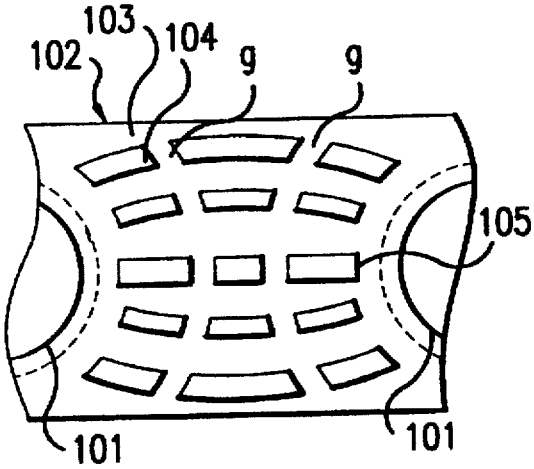
Figure 6:
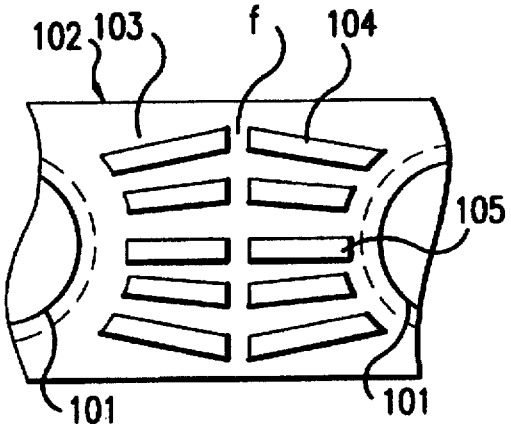
Figure 7:
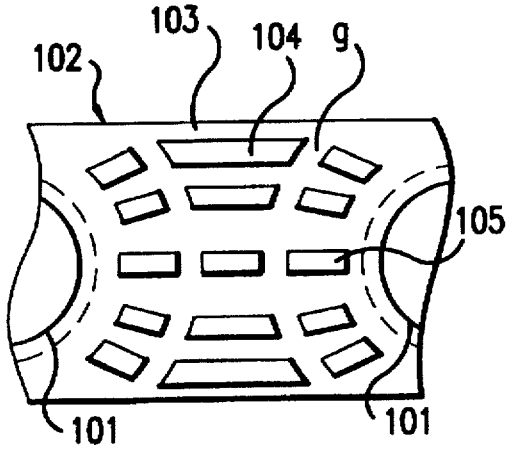

In yet another embodiments, referring to FIGS. 6 and 7, apertures 107 of strips 104 are linear not elliptical, having the same configuration as in FIGS. 4 and 5.

Figure 8:
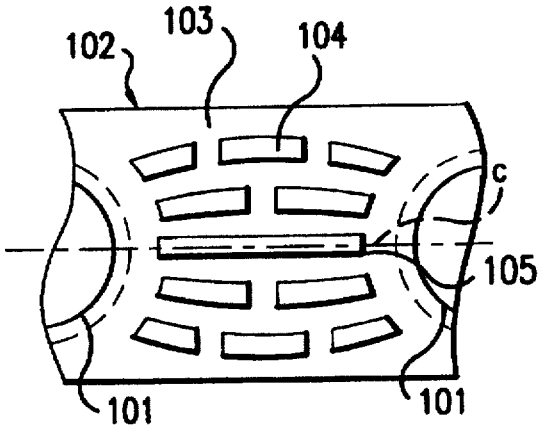
Figure 9:
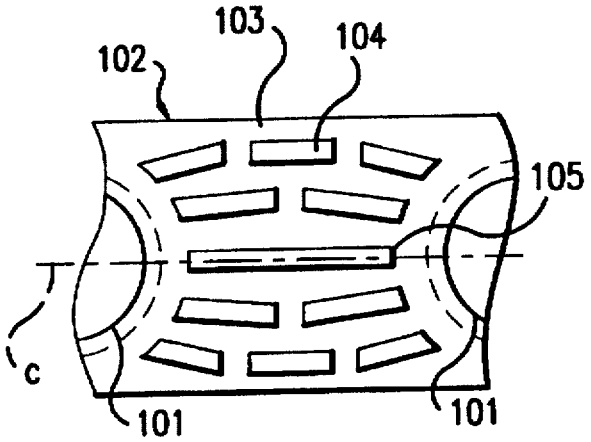
Figure 10:
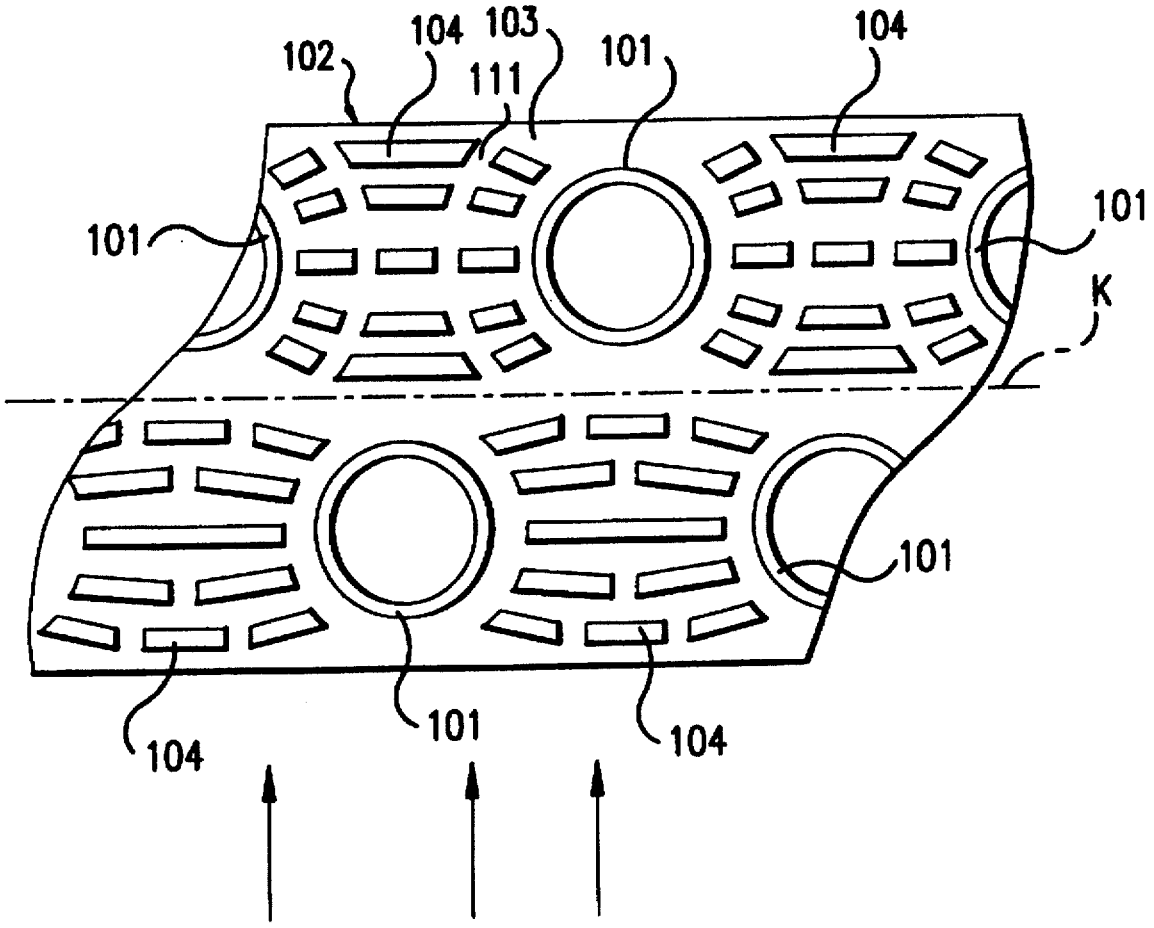

In a further embodiment, as shown in FIGS. 8 and 9, strips 104 which are far from center line S of heat transfer tube 101 and placed on the uppermost and lowermost stream sides of air flow are divided into three. Inner strips 104 are divided into two. In those embodiments, a case has been explained in which the heat transfer tubes are disposed in a single line. However, the embodiments can be implemented even in case that the heat transfer tubes are disposed in two lines with respect to the direction of air flow. In FIG. 10, yet another embodiment of the present invention is shown in which the heat transfer tubes are disposed in two lines.

Fins 102 are divided into upper stream and lower stream at the center line K. Heat transfer tubes 101 are disposed perpendicular to the direction of air flow so that the upper and lower stream sides are not superposed.

As described above, the embodiments of the present invention facilitate thermal transfer due to conduction at fins, increasing temperature difference between strips and air and thus raising thermal transfer performance. Accordingly, this minimizes a heat exchanger.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims. The above references are hereby incorporated by reference.

What is claimed is:

1. A heat exchanger comprising:

a plurality of plate fins which are disposed in parallel at a predetermined interval and between which air flows;

heat transfer tubes extending perpendicularly through said plate fins;

a plurality of strips cut from the fins between nearby heat transfer tubes, each of said strips having a pair of opposed erect portions, said strips being divided into first strips cut from a center line connecting centers of the nearby heat transfer tubes; and second strips opposingly disposed centering on the center line and formed along an ellipse having the center line in the direction of a line of apsides, the erect portions of said second strips having an inclination angle which is equal to an angle of a tangent line of a concentric circle of the heat transfer tube circumscribed with the erect portions, said first and second strips are segmented and said strips are divided along an arc having a common center as the heat transfer tubes, respectively.

2. A heat exchanger as claimed in claim 1, wherein the said second strips cut from the fins have apertures which are linear.

3. A heat exchanger as claimed in claim 1, wherein said heat transfer tubes are disposed in two lines with respect to the direction of air flow so that they are not superposed with each other.

* * * * *